US006863545B2

(12) United States Patent
Peloza

(10) Patent No.: US 6,863,545 B2
(45) Date of Patent: Mar. 8, 2005

(54) AUTOMOTIVE CONNECTOR WITH IMPROVED RETENTION ABILITY

(75) Inventor: Kirk B. Peloza, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/337,546

(22) Filed: Jan. 7, 2003

(65) Prior Publication Data

US 2003/0129864 A1 Jul. 10, 2003

Related U.S. Application Data

(60) Provisional application No. 60/346,570, filed on Jan. 7, 2002.

(51) Int. Cl.[7] ..... H01R 12/00

(52) U.S. Cl. ..... 439/79; 439/701; 439/931

(58) Field of Search ..... 439/931, 607–610, 439/569, 570, 686, 701, 374, 79, 375

(56) References Cited

U.S. PATENT DOCUMENTS

| | | | | |
|---|---|---|---|---|
| 5,035,652 A | | 7/1991 | Shibano | |
| 5,518,421 A | | 5/1996 | Davis | |
| 5,718,605 A | | 2/1998 | Morikawa et al. | |
| 5,766,041 A | | 6/1998 | Morin et al. | |
| 5,934,935 A | | 8/1999 | Kameyama | |
| 5,980,320 A | | 11/1999 | Slack et al. | |
| 6,095,865 A | * | 8/2000 | Wu | 439/607 |
| 6,168,467 B1 | | 1/2001 | Chiou | |
| 6,213,813 B1 | | 4/2001 | Huang | |
| 6,478,623 B1 | * | 11/2002 | Wu | 439/607 |
| 6,488,533 B1 | * | 12/2002 | Thompson et al. | 439/509 |
| 6,494,742 B1 | * | 12/2002 | Hu | 439/607 |
| 6,551,139 B1 | * | 4/2003 | Yu | 439/607 |

OTHER PUBLICATIONS

International Search Report for PCT/US03/00350, (Counterpart PCT Application).

* cited by examiner

*Primary Examiner*—Tho D. Ta
*Assistant Examiner*—James R. Harvey
(74) *Attorney, Agent, or Firm*—Thomas D. Paulius

(57) ABSTRACT

A conductive enclosure for a connector mounted to a circuit board is disclosed, and the enclosure is made in the form of a shroud having an enclosure portion that receives one connector therein and a receptacle portion for receiving a second connector therein that is mateable with the one connector. The enclosure portion includes an internal cavity that is defined by a plurality of walls, two of the walls have retaining members formed thereon that engage the one connector and fix a position of the one connector within the internal cavity, while a third wall of the enclosure portion includes a press member that is biased to exert a force upon the one connector when enclosed in the shroud. The retaining members provide reaction surfaces that at least partially resist the force exerted on the one connector by the press member.

20 Claims, 4 Drawing Sheets

AUTOMOTIVE CONNECTOR WITH IMPROVED RETENTION ABILITY

This application claims the benefit of Provisional Application No. 60/346,570, filed Jan. 7, 2002.

BACKGROUND OF THE INVENTION

The present invention relates generally to electronic connectors and more particularly to electronic connectors used in automotive applications that have improved retention capabilities.

Input-output ("I/O") connectors have been used for years in the consumer electronic industry for providing connections, for example, between computers and peripheral devices, such as CD and DVD players, scanners, printers and the like. These connector applications may include either parallel connections that utilize a plurality of conductive pins which are received within press-fit terminals or universal serial bus ("USB") connections that utilize flat terminals with contacts that slidingly engage each other. This sliding engagement is acceptable in home and business computer applications where the connections are typically located at the rear of the computer and peripheral, out of the way of the user.

Recently, there has been a tremendous increase in the incorporation of electronic entertainment and computer systems in automotive applications. Vehicles are being provided with videotape and DVD players, MP3 music systems, and personal entertainment, such as those manufactured by Sony, Nintendo and Microsoft. The automotive industry, as well as other transport industries, such as the aircraft industry have indicated that they shall be equipping their vehicles and aircraft with other types of electronic devices, such as computers, facsimile machines, etc.

In many of these applications, the automobile or aircraft will have an electronics center that will include various circuit boards that support the player, device or game system. One or more connectors will be mounted to the circuit board to offer a socket or receptacle into which a user or passenger can insert a plug connector in order to connect an enabling device to the player, system etc. The passengers will insert and remove these plug connectors on a repeated basis, and often more than 2 to 4 times for each vehicle trip. The trips done by a vehicle are many so that the insertion and removal cycles of the plug connector will add up over the days, weeks and months in which the vehicle is in use.

These insertion and removal cycle will impose a great deal of stress on the socket/receptacles and their means of attachment to their associated circuit boards. The present invention is therefore directed to an improved connector assembly for vehicular applications that is robust and capable of enduring repeated insertion and withdrawal cycles.

SUMMARY OF THE INVENTION

It is therefore a general object of the present invention to provide an improved connector assembly for automotive and aircraft applications with improved retention capabilities that retain the socket or receptacle in place firmly upon an associated circuit board and which has a structure that more effectively secures the connector to the circuit board while resisting stresses imposed thereupon during insertion and withdrawal.

Another object of the present invention is to provide a connector system for vehicular applications including a circuit board, a connector attached to the circuit board and a shroud member that encloses the connector and maintains the connector in its desired position on the circuit board.

Still another object of the present invention is to provide a robust I/O connector assembly for automotive applications in which the connector assembly is subject to repeated insertion and removal cycles, and wherein the connector assembly includes a female socket-style connector that receives a plug connector therein, the connector assembly further including a protective shroud that is attached to the circuit board and which at least partially encloses the female connector, the shroud having a press arm that engages an exterior surface of the female connector, and exerting a retention force thereupon to maintain the shroud in a position on the circuit board.

Another object of the present invention is to provide a shielded housing for a high-speed electrical connector, the housing having the form of a hollow shroud with an insulative body portion that is divided into two sections, one that houses a socket connector and the other that receives an opposing plug connector, the housing body portion further including a wall portion that divides the housing body portion and which provides a means for attaching the housing to a wall or mounting bulkhead of a vehicle, the housing portion of the shroud including a hollow cavity with two retention members extending into the cavity and engaging portions of the socket connector, the housing portion further including a press member formed in an exterior wall of the housing, the press member being oriented on the housing portion to exert a force on the socket connector that opposes forces applied to the socket connector by the inner retention members.

Still another object of the present invention is to provide the aforementioned shroud with a shield component, the shield component including the plating of the exterior surfaces of the shroud with a conductive metal, such that the shroud encompasses the connector from the circuit board up to and through a bulkhead or other support to which the shroud penetrates, the exterior plated surface of the shroud providing a measure of electromagnetic interference ("EMI") protection.

Yet another object of the present invention is to provide a conductive enclosure for a connector mounted to a circuit board, the enclosure taking the form of a shroud having an enclosure portion that receives one connector therein and a receptacle portion for receiving a second connector therein that is mateable with the one connector, the enclosure portion having an internal cavity that is defined by a plurality of walls, two of the walls have retaining members formed thereon that engage the one connector and fix a position of the one connector within the internal cavity, while a third wall of the enclosure portion includes a press member that is biased to exert a force upon the one connector when enclosed in the shroud, the retaining members providing reaction surfaces that at least partially resist the force exerted on the one connector by the press member.

The present invention accomplishes the aforementioned objects by way of its novel and unique structure. Accordingly, in one principal aspect of the present invention, a female-style socket connector is provided for mounting to a circuit board. A larger shroud member is provided and has an internal cavity that receives almost all of the socket connector therein such that the shroud extends around most of the socket connector and the shroud member mates with a surface of the circuit board. The shroud includes a press arm that contacts an exterior surface of the socket connector in order to exert a force upon the socket connector, typically a downward force, that maintains the socket connector in a designated position on the circuit board so that it may be reliably soldered or otherwise attached thereto. This downward force is in opposition to reaction forces exerted on the socket connector by internal retention arms of the shroud member.

In another principal aspect of the present invention, the press arm of the shroud is formed integrally therewith and extends in a cantilevered fashion within a slot formed in an exterior wall of the shroud. Preferably, the press arm extends in a horizontal fashion within a top wall of the shroud and includes a free end that is located intermediate two opposing ends of the socket connector. The socket connector may itself have an outer conductive shield, and thus it is desired that the press arm be plated with a conductive material so that an electrical, or grounding, connection may be established from the shroud to the exterior grounding shell, or shield, of the socket connector.

In still another principal aspect of the present invention, the shroud is provided with one or more retaining tabs formed therewith and disposed within the internal cavity of the shroud. These retaining tabs engage other exterior surfaces of the socket connector and preferably these surfaces will be oriented opposite the exterior surface which the shroud press arm contacts. These retaining tabs serve not only to retain the socket connector in place within the shroud, but also provide additional points of electrical connection between the shroud and the socket connector. The retaining tabs serve to provide reaction surfaces that are oriented opposite the press arm and serve to at least partially resist forces applied to the socket connector by the press arm.

In yet another principal aspect of the present invention, the socket connector includes a series of mounting feet that are received within corresponding mounting holes formed in the circuit board, and the socket connector includes one or more extensions that extend from near the mounting feet and which serve as a means to limit the distance which the shroud may press the socket connector down into contact with the circuit board so as to give the connector system an anti-overstress measure.

These and other objects; features with advantages of the present invention will become apparent from the following detailed description, taken in conjunction with the accompanying drawings.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Figure 1:
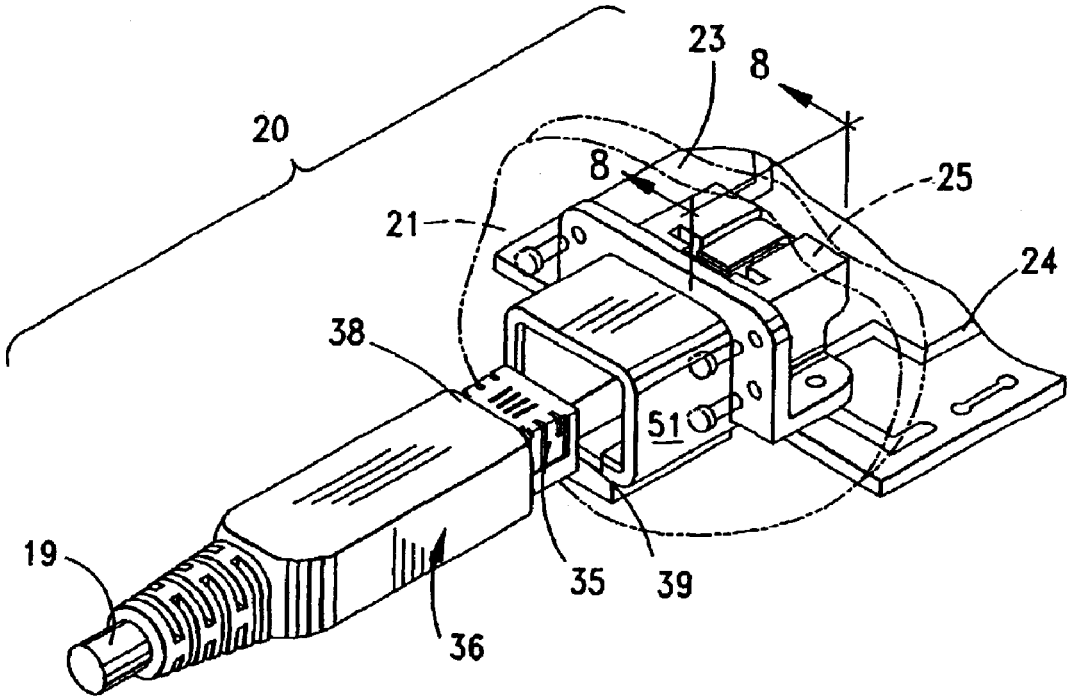
FIG. 1 is a perspective view of a connector assembly that utilizes a protective retention shroud constructed in accordance with the principles of the present inventions and with a cable plug connector aligned therewith.

FIG. 1 illustrates an overall electronic system portal 20 that may be used in a vehicular application. In this description the term "vehicle" is to be given its broadest interpretation and is not to be limited to conventional land vehicles, but will include aircraft and watercraft as well as other craft.

The portal 20 will typically be formed in a bulkhead or wall 21 illustrated in phantom that faces into the interior of the vehicle. In the space behind the bulkhead or wall 21, a circuit board 23 is supported and extends to an electronic device (not shown) and further includes on the surface(s) thereof, a plurality of conductive traces 24 that form circuit paths from the device to a connector 25 supported on the circuit board 23 (FIG. 3).

Figure 3:
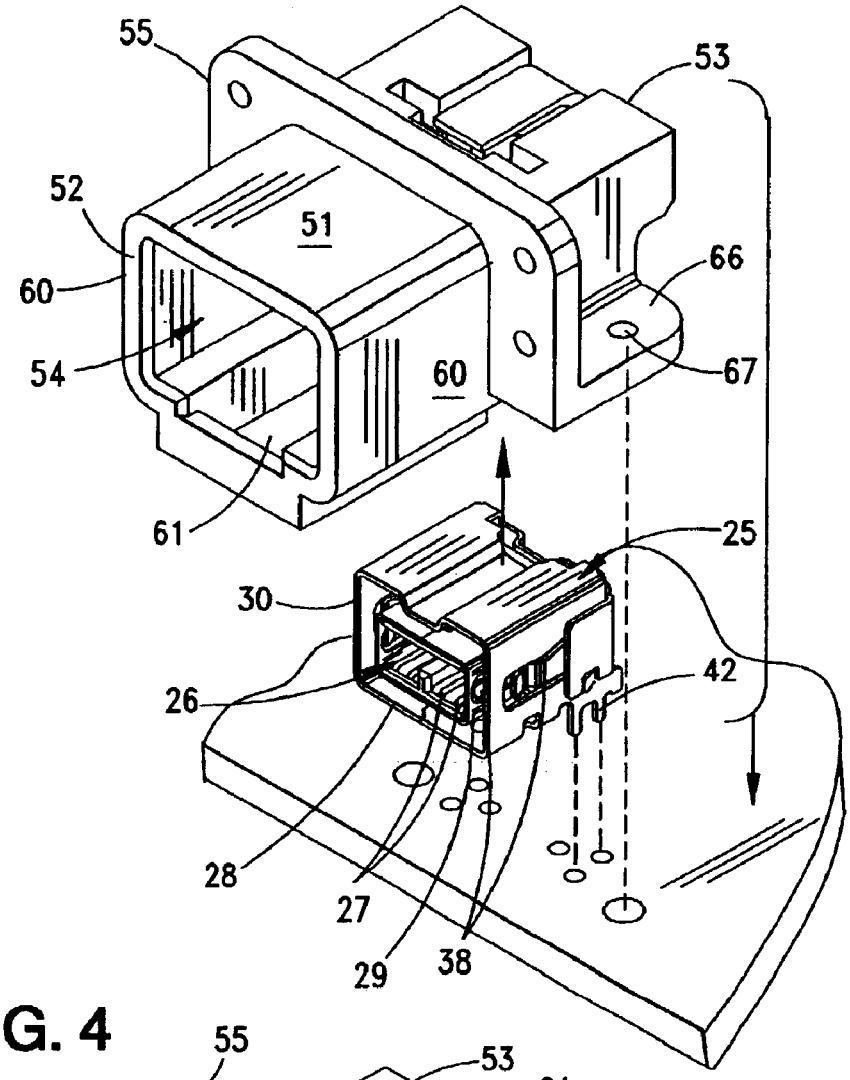
FIG. 3 is an exploded view of the connector assembly of FIG. 1, illustrating the interrelationship among the assembly components.
Figure 4:
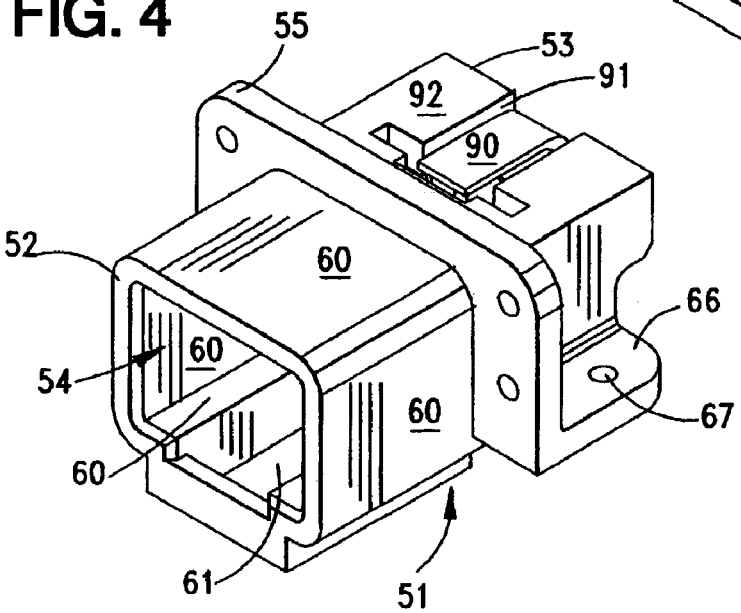
FIG. 4 is a perspective view of the shroud component of the connector assembly of FIG. 1.

Turning to FIG. 3, it can be seen that the connector 25 is a socket, or receptacle-style connector, preferably of the IEEE 1394, 1394a or 1394b variety, where the dimensions are very small and the connectors must be mounted to and supported by the circuit board at a particular mounting distance. Such a connector and its structure are described in detail in U.S. Pat. No. 6,280,209, owned by the assignee of this invention. The connector 25 may include an inner contact cavity 26 in which a plurality of contacts 27 are supported by way of an insulative housing 28. This housing 28 may be partially enclosed by a first, or inner conductive shield 29, which in turn is partially enclosed by a second, or outer conductive shield 30.

The two shields 29, 30 are spaced apart from each other a predetermined distance to form an annular cavity 32 as shown that preferably receives the outer walls 35 of a correspondingly opposing plug connector 36 (FIG. 1). The two shields 29, 30 preferably include one or more spring arms 38 formed therewith that serve to exert a retention force on the plug connector 36 when it is inserted into the socket connector 25.

Figure 2:
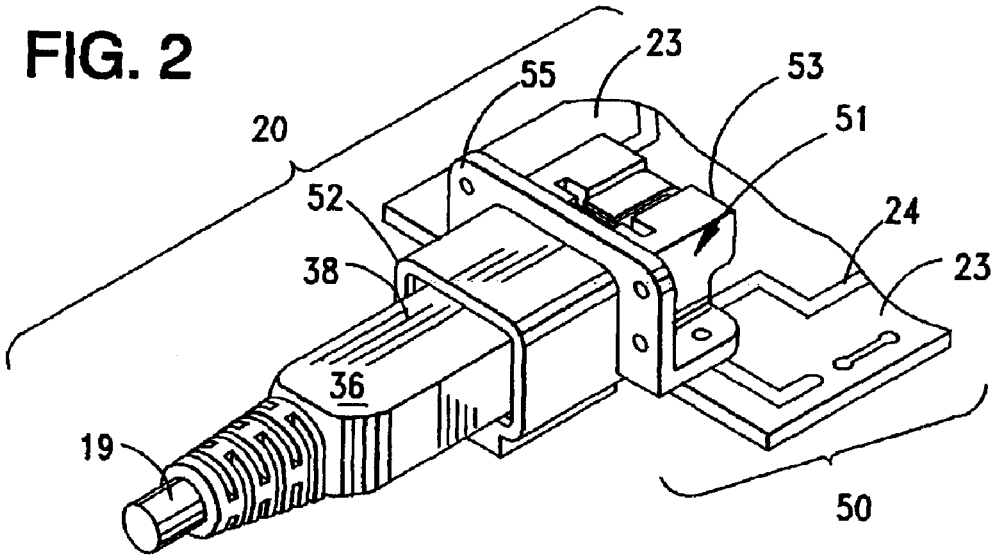
FIG. 2 is a perspective view of the connector assembly of FIG. 1 with the plug connector fully inserted into the connector assembly.
Figure 6:
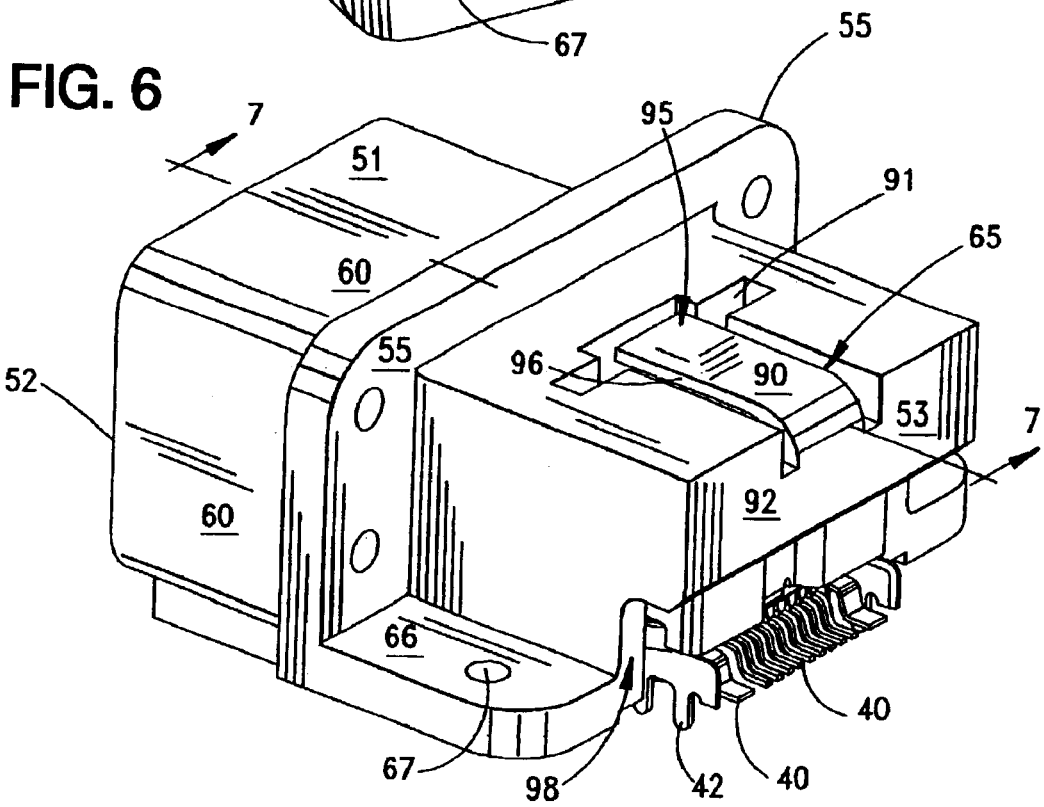
FIG. 6 is a perspective view of the shroud component of FIG. 4 taken from the rear and shown in place over a socket connector.

The socket connector 25, as shown in FIG. 6, includes a plurality of terminal tails 40 that extend out of the connector from the terminals 27 and which serve to connect the terminals 27 of the connector 25 to the traces 24 on the circuit board 23. Although shown as surface mount tails 40, the tails of the socket connector may also be of the through hole type which are received within plated mating holes on the circuit board. The inner and outer shields 29, 30 may also have grounding tabs 42 for connecting to the circuit board 23. (FIG. 3.) The socket connector receives a plug connector 36 as shown in FIGS. 1 & 2, that is attached to a cable 19. The plug connector 36 is shown inverted from its ordinary orientation.

The present invention is directed to an improved connector assembly 50 that in its broadest sense includes the circuit board 23, the connector 25 mounted thereto and a protective shroud 51 that protects and at least partially encloses the connector 25. The shroud 51 serves as a protective housing for the connector 25 and it has been noted by applicant that it is difficult to manufacture a housing for a small connector such as that of the USB or 1394a and 1394b varieties that is fastened and must be supported a specific distance from the circuit board 23 because manufacturing tolerances are very tight. Connectors 25 such as of the style shown have dimensions of about 0.375 by 0.5 by 0.28 inches, for example. With such small dimensions, it is desired to protect the connector, yet hold it in place on the circuit board. Furthermore, in such a small dimensional environment, the connection areas of the socket connector to the circuit board are also very small and are susceptible to high stresses that are caused by the insertion and removal of a plug connector.

FIG. 3 illustrates the shroud 51 and as shown it includes a front face 52 and a rear face 53 that may be separated by an intervening mounting wall 55. The front face 52 is hollow, with a passage 54 formed therein, that is preferably sized to receive the mating end 39 and body portion 38 of the opposing plug connector 36. The shroud passage 54 is seen as defined by a plurality of walls 60, the bottom one of which may be provided with a slot 61 for engagement by a latch (not shown) that is formed on the opposing connector body portion 38. The front face 52 is preferably continuous, even across the slot 61 so as to provide, if needed, means for engaging a latch on the opposing connector 36.

Figure 5:
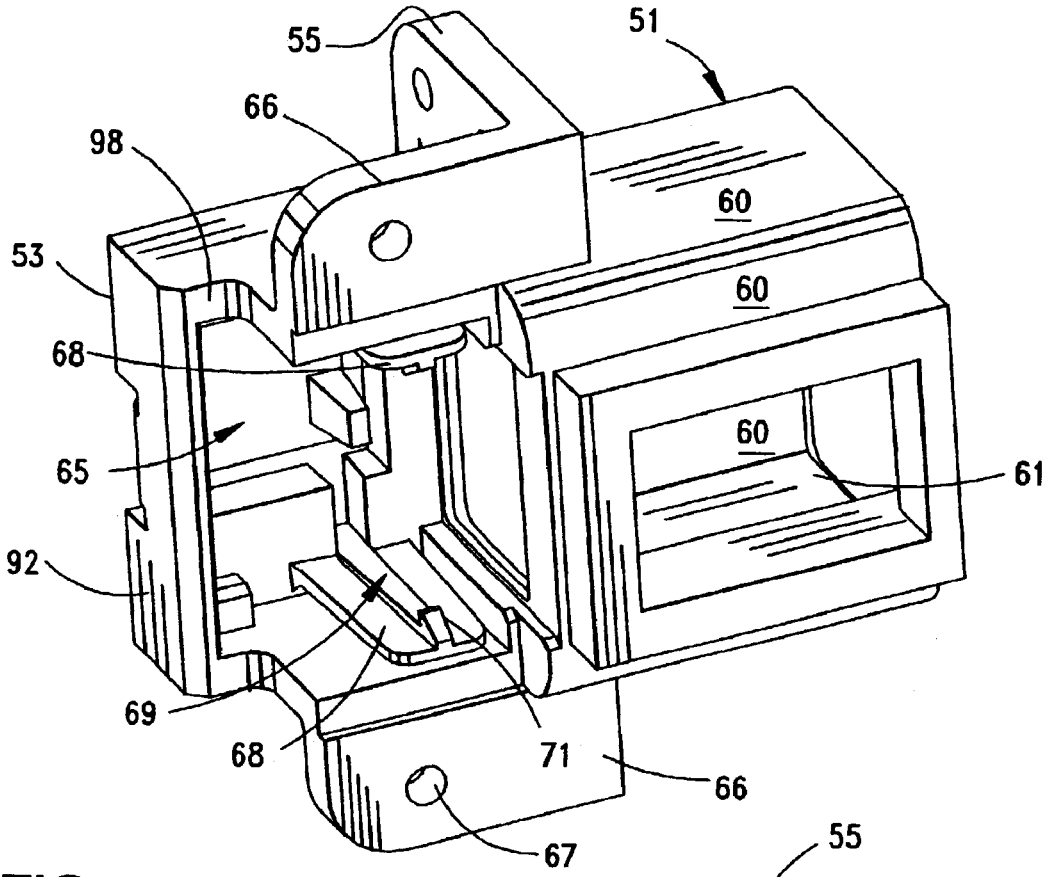
FIG. 5 is a perspective view of the shroud component of FIG. 4 taken from the bottom thereof.

In FIG. 5, the bottom sides, or surfaces of the shroud 51 are depicted, and the shroud 51 can be seen to include on the opposite side of the mounting wall 55, another internal cavity 65 into which the connector 25 fits. The insertion of the connector 25 is achieved from the bottom of the shroud 51 as shown in FIG. 3 to form an assembly that may then be mounted to the circuit board 23. In this regard, the shroud 51 is preferably provided with mounting flanges 66 and holes 67 by which the shroud 51 may be mounted and attached to the circuit board 23 by way of screws, rivets, solder board locks or the like.

As shown in FIG. 5, the shroud rear cavity 65 is preferably provided with one or more retainers 68, shown in the form of a pair of vertical arms 69, with each arm having a free end 70 that terminates with an offset (shown as inwardly-extending) catch, or shoulder 71. These catches 71 engage the outer shield 30 of the connector 25 by fitting in a pair of corresponding notches 80 formed therein, illustrated as disposed at the outer and lower edges with the connector 25. The catches will bear against the upper faces 81 of these notches 80 and will retain the connector 25 in place in the shroud 51. The catches serve as reaction surfaces to resist forces that may be exerted on the socket connector 25 by the spring, or press arm 90. In this regard, as seen in FIG. 5, it is desired to have the flat ends of the catches lie in a common plane so that any reaction forces will be equal. It can be seen that the catches engage the bottom edges of the socket connector while the spring arm engages the top surface of the socket connector. IN this manner, and in cooperation with the mounting flanges 66 of the shroud, the shroud serves to protect the socket connector from detrimental stresses that may be generated due to insertion and removal of an plug connector from the socket connector 25.

Figure 7:
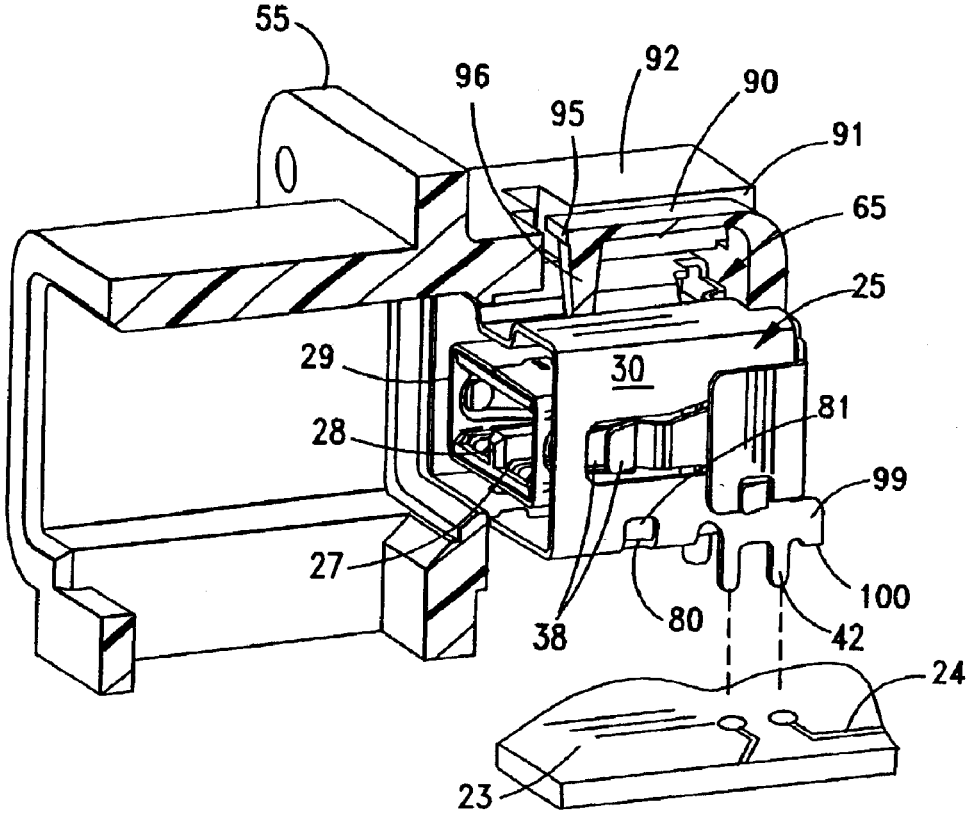
FIG. 7 is a sectional view of FIG. 6 taken along lines 7—7 thereof and only through the shroud component of FIG. 6.

In an important aspect of the present invention, the shroud 51 includes a spring arm 90 that is preferably formed integral with the shroud 51. As best seen in FIGS. 6 and 7, the spring arm extends within a slot 91 formed in the rear half of the shroud and which communicates with the rear internal cavity 65 thereof. The spring arm 90 can be seen to extend in a cantilevered fashion extending first vertically within the rear face 53 of the shroud and then horizontally within the top wall 92 of the rear half of the shroud 51. The spring arm 90 terminates in a free end 95 that has a press member 96 which extends downwardly therefrom into the rear internal cavity 65.

The top of the press member 96 contacts the exterior surface of the outer shield 90 of the connector 25 and in this regard, it is desired to cast, or plate some or all of the exterior surfaces of the shroud 51 with a conductive material. This can be easily done by molding the shroud from a material, such as plastic, and then plating it. With the plating, an electrical connection between the circuit board 23 and the shroud 51 can be established with the point of connection occurring in or along the mounting flange 66. An electrical connection is also established between the shroud 51 and the connector at the tip of the press member 96 and if desired, at the ends of the retaining catches 71.

In operation, the cantilevered spring arm 90 pushes the connector 25 into contact with and positions on the circuit board 23, so that the connector 25 especially the terminal tails 40 thereof, may be soldered in a re-flow type of soldering operation. The shroud 51 serves as a means to protect the covered connector 25 from loads incurred in cycles of insertion and removal of the plug connector 36 as well as vibrations that might be transmitted through the connecting cable 19 and plug connector 36 by the user.

The intermediate mounting wall 55 permits the shroud 51 and the circuit board 23 to be supported on a bulkhead or mounting wall 21. The shroud rear face 53 preferably does not extend down to the surface of the circuit board 23 and may include a recessed portion 98 (FIG. 6). That permits entrance to the terminal tail area during the reflow solder process.

Figure 8:
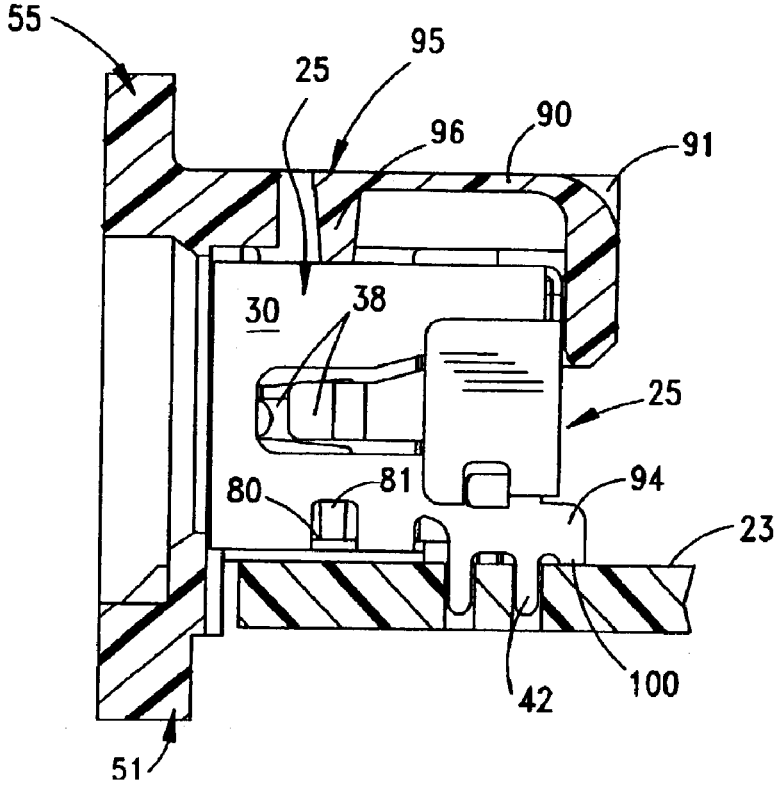
FIG. 8 is a sectional view of the connector assembly of FIG. 1 taken along lines 8—8 thereof.

In order to prevent the connector terminal tails 40 from being overstressed or bent, the outer shield 30 of the connector 25 may be provided with over-travel feet 99 (FIGS. 7 & 8) that have stop surfaces 100 in opposition to the circuit board 23 and will limit the downward travel of the connector 25 through its terminal tails 40 and grounding tails 42.

Although the present invention has been described in terms of an insulative body with a conductive coating, it will be understood that other structures may be suitable. For example, conductive surfaces of the shroud may be formed with inserts, or the shroud may be die cast from a conductive material. The shroud not only substantially encloses the socket connector (on at least three sides thereof), but it also provides a means of holding the socket connector in place within the shroud and attached to the circuit board in a manner that relieves insertion and removal stress from being transferred to the solder connections between the socket connector and the circuit board.

While the preferred embodiment of the invention have been shown and described, it will be apparent to those skilled in the art that changes and modifications may be made therein without departing from the spirit of the invention, the scope of which is defined by the appended claims.

What is claimed is:

1. An electronic connector assembly comprising:

a printed circuit board including a plurality of electrically conductive traces; a socket connector including a plurality of terminals, the socket connector being disposed on the printed circuit board such that the terminals are operatively connected to the traces; and, a shroud for enclosing said socket connector, the shroud including an internal cavity operatively connected to the printed circuit board such that a substantial portion of the socket connector is disposed within the shroud internal cavity, the shroud further including a press arm having a free end which contacts a first surface of said socket connector in order to maintain said socket connector in a desired orientation relative to said printed circuit board, wherein said shroud is formed from a plastic and is plated with a conductive coating so that points of contact between said shroud and said socket connector establish conductive, electrical paths.

2. The electronic connector assembly as recited in claim 1, wherein the free end exerts a force on said socket connector in the direction of said printed circuit board.

3. The electronic connector assembly as recited in claim 1, wherein said internal cavity is defined by a plurality of walls and the press arm is integrally formed in one of the walls.

4. The electronic connector assembly as recited in claim 1, wherein said shroud includes a rear wall and a top wall, and said press arm is integrally formed in the rear wall and extends cantilevered within a slot defined in the top wall.

5. The electronic connector assembly as recited in claim 1, wherein the press arm free end is disposed such that contact with said socket connector occurs at a location intermediate opposed ends of said socket connector.

6. The electronic connector assembly as recited in claim 1, wherein the first surface of said socket connector includes a shield and said press arm includes a conductive portion disposed thereon for contacting the shield to define a ground communication path between the shield and the traces.

7. The electronic connector assembly as recited in claim 1, wherein said socket connector includes a series of mounting feet for engaging holes formed in said circuit board and at least one over travel member disposed adjacent the mounting feet which contacts said printed circuit board and limits engagement between said mounting feet and said printed circuit board.

8. The electronic connector assembly as recited in claim 1, wherein said shroud includes a plurality of walls, and a first plurality of said walls defines an enclosure portion of said shroud that receives said socket connector therein, and a second plurality of walls that defines a receptacle portion for receiving a plug connector that mates with said socket connector.

9. The electronic connector assembly as recited in claim 3, wherein said shroud further includes at least two retaining members formed therewith which are spaced apart from said press arm and which engage said socket connector on second and third surfaces of said socket connector.

10. The electronic connector assembly as recited in claim 9, wherein said two retaining members are formed on a pair of opposing walls of said shroud and said press arm is formed on a different wall of said shroud.

11. A shroud for orienting a socket connector relative to a circuit board that extends in a first plane, the socket connector having an exterior conductive shield, said socket connector being mountable to the circuit board, comprising:

a body, the body having a passage defined by a first set of walls and a cavity defined by a second set of walls, the passage and cavity being separated by a mounting wall of said body, and the mounting wall having an aperture communicating between the passage and cavity;

at least one retaining member formed in a first wall of said second set of walls, the retaining member extending into said cavity so as to engage a first surface of said socket connector when said shroud is applied to said socket connector; and, a press arm formed a second wall of the second set of walls and extending at least partially into said cavity in a cantilevered manner, the press arm having a free end that contacts a second surface of said socket connector when said shroud is applied to said socket connector, said press arm free end opposing said retaining member so that said retaining member at least partially resists any force exerted on said socket connector by said press arm free end.

12. The shroud as claimed in claim 11, wherein said shroud includes means for attaching said shroud to a circuit board and said press arm exerts a force on the socket connector in the direction of the printed circuit board so that the circuit board is disposed beneath said shroud and said socket connector when said shroud is applied to said socket connector and said shroud and socket connector are both mounted to a circuit board.

13. The shroud as claimed in claim 11, wherein said second set of walls includes a rear wall and a top wall, and said press arm is integrally formed in the rear wall and extends cantilevered within a slot defined in the top wall.

14. The shroud as claimed in claim 13, wherein said second set of walls further includes a pair of sidewalls extending at an angle from said rear and top walls, and said first wall is one of said sidewalls.

15. The shroud as claimed in claim 14, further including a second retaining member formed in the other of said sidewalls, each of said retaining members having a shoulder portions that extends into said cavity, said shoulders defining reaction surfaces that engage said socket connector and resist force applied to said socket connector by said press arm.

16. The shroud as claimed in claim 11, wherein said shroud includes a conductive coating such that said shroud defines an electrically conductive path between said shroud and said socket connector shield.

17. The shroud as claimed in claim 15, wherein said shoulder portions are spaced apart from and disposed opposite said press arm free end.

18. The shroud as claimed in claim 17, wherein said should portions lie in a common plane.

19. A shroud for retaining a socket connector on a circuit board, the socket connector having an exterior conductive shield and having a plurality of terminal tail portions that are attachable to the circuit board, comprising:

a hollow body including an internal cavity that receives at least a portion of said socket connector therein when said shroud is applied to said socket connector, a receptacle portion for receiving a plug connector that is mateable with said socket connector, the shroud body including a pair of retaining members formed in opposing walls of the cavity, the retaining members extending into said cavity so as to engage first surfaces of said socket connector when said shroud is applied to said socket connector, the body being conductive so as to provide a conductive electrical path between said shroud and said socket connector; and, a press arm having a free end which contacts a second surface of the socket connector, the press arm free end extending at least partially into said cavity in a cantilevered manner in opposition to said retaining members, the press arm having a free end that contacts a second surface of said socket connector when said shroud is applied to said socket connector, said press arm free end opposing said retaining members so that said retaining members resist force exerted on said socket connector by said press arm free end.

20. An electronic connector assembly comprising:

a printed circuit board including a plurality of electrically conductive traces; a socket connector including a plurality of terminals, the socket connector being disposed on the printed circuit board such that the terminals are operatively connected to the traces; and, a shroud for enclosing said socket connector, the shroud including an internal cavity operatively connected to the printed circuit board such that a substantial portion of the socket connector is disposed within the shroud internal cavity, the shroud further including a press arm having a free end which contacts a first surface of said socket connector in order to maintain said socket connector in a desired orientation relative to said printed circuit board, said shroud includes a rear wall and a top wall, and said press arm is integrally formed in the rear wall and extends cantilevered within a slot defined in the top wall.

* * * * *